US010122112B2

(12) United States Patent
Sato et al.

(10) Patent No.: US 10,122,112 B2
(45) **Date of Patent: *Nov. 6, 2018**

(54) ELECTRIC CONNECTOR

(71) Applicant: IRISO ELECTRONICS CO., LTD., Kanagawa (JP)

(72) Inventors: Katsumasa Sato, Kanagawa (JP); Hiroaki Kobayashi, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/118,573

(22) PCT Filed: Feb. 18, 2015

(86) PCT No.: PCT/JP2015/054499
§ 371 (c)(1),
(2) Date: Aug. 12, 2016

(87) PCT Pub. No.: WO2015/125839
PCT Pub. Date: Aug. 27, 2015

(65) Prior Publication Data

US 2017/0054241 A1 Feb. 23, 2017

(30) Foreign Application Priority Data

Feb. 18, 2014 (JP) ..... 2014-028906

(51) Int. Cl.
*H01R 24/00* (2011.01)
*H01R 13/24* (2006.01)
(Continued)

(52) U.S. Cl.
CPC ..... *H01R 13/2457* (2013.01); *H01R 12/716* (2013.01); *H01R 12/721* (2013.01);
(Continued)

(58) Field of Classification Search
CPC ..... H01R 12/57; H01R 12/71; H01R 12/716; H01R 12/72; H01R 12/721; H01R 12/73;
(Continued)

(56) References Cited

U.S. PATENT DOCUMENTS 3,414,871 A 12/1968 Tuchel
3,631,381 A * 12/1971 Pittman ..... H01R 12/721 439/637
(Continued)

FOREIGN PATENT DOCUMENTS

JP 53-95573 A 8/1978
JP 2009-199766 A 9/2009
(Continued)

OTHER PUBLICATIONS

International Search Report for PCT Patent App. No. PCT/JP2015/054499 (dated Apr. 7, 2015) with English language translation.
(Continued)

*Primary Examiner* — Michael A Lyons
*Assistant Examiner* — Milagros Jeancharles
(74) *Attorney, Agent, or Firm* — Cermak Nakajima & McGowan LLP; Tomoko Nakajima

(57) ABSTRACT

A connector which is provided with connector terminals which include a plurality of terminals that are configured to be in contact with a connection target and achieves reliable contact with the connection target while preventing the plurality of terminals from being in contact with each other when the plurality of terminals come into contact with the connection target and are displaced by the connection target is provided. A connector includes a housing and a connector terminal, and the connector terminal includes a front terminal including a contact portion that comes into contact with a plug connector inserted from an insertion port of the housing and an elastic arm that supports the contact portion
(Continued)

in a displaceable manner; and a rear terminal including a contact portion that comes into contact with the plug connector subsequent to the contact portion of the front terminal and an elastic arm.

6 Claims, 12 Drawing Sheets

(51) Int. Cl.
*H01R 12/71* (2011.01)
*H01R 12/72* (2011.01)
*H01R 12/73* (2011.01)
*H01R 13/05* (2006.01)
*H01R 12/57* (2011.01)

(52) U.S. Cl.
CPC ..... *H01R 12/737* (2013.01); *H01R 13/055* (2013.01); *H01R 12/57* (2013.01)

(58) Field of Classification Search
CPC ..... H01R 13/05; H01R 13/11; H01R 13/24; H01R 33/76; H01R 33/88; H01R 13/2457; H01R 13/055; H01R 23/70
USPC ..... 439/70, 71, 630–751, 59, 60
See application file for complete search history.

(56) References Cited

U.S. PATENT DOCUMENTS 4,322,431 A * 3/1982 Habicht ..... C07D 235/12 514/394
4,806,110 A * 2/1989 Lindeman ..... H01R 13/2407 439/108
5,730,609 A * 3/1998 Harwath ..... H01R 12/721 439/108
6,203,328 B1 * 3/2001 Ortega ..... H01R 12/721 439/60
6,290,515 B1 * 9/2001 Lee ..... H01R 23/688 439/108
6,979,228 B2 * 12/2005 Zhang ..... H01R 12/721 439/660
7,291,037 B2 * 11/2007 Tsai ..... H01R 12/592 174/254
7,637,783 B2 * 12/2009 Sasaoka ..... H01R 43/16 439/637
8,079,858 B2 * 12/2011 Naito ..... H01R 12/7076 362/217.17
8,651,893 B2 * 2/2014 Ogura ..... H01R 12/716 439/260
9,160,122 B2 * 10/2015 Sato ..... H01R 12/91
9,225,089 B2 * 12/2015 Sato ..... H01R 4/028
2009/0209142 A1 8/2009 Sasaoka et al.
2012/0142226 A1 * 6/2012 Funayama ..... H01R 12/716 439/692
2012/0252275 A1 * 10/2012 Tajiri ..... H01R 12/585 439/630
2013/0040505 A1 * 2/2013 Hirakawa ..... H01R 12/721 439/733.1

FOREIGN PATENT DOCUMENTS

JP 2009-252588 A 10/2009
JP 2010-040309 A 2/2010

OTHER PUBLICATIONS

Office Action from Chinese Patent App. No. 201580008139.3 (dated Jan. 26, 2018).

* cited by examiner

ELECTRIC CONNECTOR

This application is a national phase entry under 35 U.S.C. § 371 of PCT Patent Application No. PCT/JP2015/054499, filed on Feb. 18, 2015, which claims priority under 35 U.S.C. § 119 to Japanese Patent Application No. 2014-028906, filed Feb. 18, 2014, both of which are incorporated by reference.

TECHNICAL FIELD

The present invention relates to connectors electrically connected to connection targets.

BACKGROUND ART

There are known connectors which are provided with connector terminals having a front terminal that comes into contact with a connection target such as an FPC or a plug connector and a rear terminal that comes into contact with the connection target subsequent to connection of the front terminal. The connector terminals are housed in a housing of the connector, and the front terminal and the rear terminal each have a contact portion having a contact edge that comes into press contact with a connection target. The housing has an insertion port for the connection target and a mating chamber in which the connector terminal comes into contact with the connection target inserted from the insertion port. Each contact portion protrudes into the mating chamber from a slit which is formed as an opening of a terminal housing groove disposed on the inner wall of the mating chamber so that the contact portion comes into contact with a connection target inserted from the insertion port (see Patent Literature 1 as an example).

In manufacturing of the connector terminals, the shapes may slightly vary or the assembly positions may be displaced. This may cause the distal end of the contact portion of the rear terminal to protrude from the slit and abut the connection target during mating, leading to buckling or breaking in a mating chamber. In order to prevent such problems, the contact portion of the front terminal may be disposed to cover the upper side of the distal end of the contact portion of the rear terminal which faces the insertion port of the housing to achieve a prevention effect to a certain extent, since insertion of the connection target can be first accommodated by the contact portion of the front terminal and then by the contact portion of the rear terminal (see the first embodiment of Patent Literature 1). In order to further improve the prevention effect, a terminal structure has been proposed which has a gap in the contact portion of the front terminal so as to house the distal end of the contact portion of the rear terminal (see the second embodiment of Patent Literature 1 as disclosure of a similar structure). Use of the above connector terminal may limit the position of the distal end of the contact portion of the rear terminal to the inside of the gap of the front terminal. This configuration can reduce abutting of the connection target. Accordingly, the above problem of the contact portion of the rear terminal protruding into the mating chamber can be eliminated in a reliable manner.

CITATION LIST

Patent Literature

PTL 1: Japanese Unexamined Patent Application Publication No. 2010-40309

SUMMARY OF INVENTION

Technical Problem

However, as seen in the connector of the second embodiment of Patent Literature 1, if the rear terminal is hooked and is displaced in the same direction as the front terminal when the contact portion of the front terminal is displaced, the rear terminal is also displaced by the front terminal. This causes a problem that the insertion of the front terminal becomes unsmooth during insertion of the connection target, thereby deteriorating insertion properties.

Moreover, in order to achieve reliable contact of the contact portion of the front terminal and the contact portion of the rear terminal to the connection target, increased contact pressure of the contact portion of the front terminal and the contact portion of the rear terminal is necessary. However, if the front terminal and the rear terminal come into contact with each other, their contact pressure are affected by each other.

In addition, since the front terminal and the rear terminal are typically rounded to remove burr on the cut edge, a thickness of the edge is usually smaller than the thickness of the original terminal material. As a result, when the contact portion of the front terminal comes into contact with the contact portion of the rear terminal, the edge of the front terminal overlaps the edge of the rear terminal, causing the front terminal to be stucked in the terminal housing groove. This causes a problem that the contact portion of the front terminal and the contact portion of the rear terminal may fail to appropriately establish electric connection to the connection target.

The present invention has been made in light of the aforementioned conventional art. It is an object of the present invention to provide a connector which is provided with connector terminals which include a plurality of terminals that are configured to be in contact with a connection target and achieves reliable contact with the connection target while preventing the plurality of terminals from being in contact with each other when the plurality of terminals come into contact with the connection target and are displaced by the connection target.

Solution to Problem

In order to achieve the aforementioned object, the present invention is configured as follows.

According to an aspect of the present invention, a connector is provided which includes a housing and a connector terminal, the connector terminal including: a front terminal including a contact portion that comes into contact with a connection target inserted from an insertion port of the housing and an elastic piece that supports the contact portion in a displaceable manner; and a rear terminal including a contact portion that comes into contact with a connection target subsequent to the contact portion of the front terminal and an elastic piece that supports the contact portion in a displaceable manner, wherein the rear terminal includes a contact that is disposed on the contact portion and comes into contact with a connection target inserted from the insertion port, and the elastic piece has a displacement fulcrum which is located at a position closer to the connection target inserted in the housing than to the contact is.

The rear terminal of the present invention includes a contact that is disposed on the contact portion and comes into contact with a connection target inserted from the insertion port, and the elastic piece has a displacement fulcrum which is located at a position closer to the connection target inserted in the housing than to the contact is. Accordingly, as the elastic piece rotates in a downwardly inclined direction about the displacement fulcrum, the contact portion of the rear terminal is rotatably displaced to the obliquely lower side. As a result, the contact portion of the rear terminal is displaced away from the contact portion of the front terminal. Since the rear terminal is displaced in the above manner, the front terminal and the rear terminal can be prevented from being in contact with each other in the mating process in which they are in contact with the connection target even if they are disposed in the same terminal housing groove, and can be in contact with the connection target in a reliable manner.

According to the above aspect of the present invention, the front terminal may include a contact that comes into contact with a connection target inserted from the insertion port, and the contact may be located at a position closer to the connection target inserted in the housing than the displacement fulcrum of the elastic piece is.

In the front terminal of the present invention, the contact that comes into contact with a connection target inserted from the insertion port is located at a position closer to the connection target inserted in the housing than the displacement fulcrum of the elastic piece is. Accordingly, as the elastic piece rotates in an upwardly inclined direction about the displacement fulcrum, the contact portion of the front terminal is rotatably displaced to the obliquely upper side. As a result, the contact portion of the front terminal is displaced away from the contact portion of the rear terminal. Further, since the rear terminal rotates in a downwardly inclined direction, while the front terminal rotates in an upwardly inclined direction, the contact portion of the rear terminal and the contact portion of the front terminal moves away from each other. That is, the contact portions move in mutually different directions. Accordingly, the front terminal and the rear terminal can be ensured so as not to come into contact with each other.

According to the above aspect of the present invention, the front terminal includes a gap between the contact portion and the elastic piece so as to house an end of the contact portion of the rear terminal which faces the insertion port.

With this configuration, the position of the distal end of the contact portion of the rear terminal can be limited to the inside of the gap. Since the distal end of the contact portion of the rear terminal does not protrude toward the connection target from the front terminal, a problem such as bending or buckling of the rear terminal caused by the connection target abutting during mating does not occur. The gap may be provided as a recess between the contact portion of the rear terminal and the elastic piece.

According to the above aspect of the present invention, the contact of the rear terminal may be a portion of an edge from a contact position that is initially in contact with a connection target inserted from the insertion port to a contact position that is in contact with the connection target at a regular mating position.

Since the contact of the rear terminal may be provided as the edge portion, the aforementioned rotation operation of the rear terminal can be achieved when the edge portion comes into contact with a connection target member.

According to the above aspect of the present invention, the contact of the rear terminal may be a portion of an edge from a contact position that is initially in contact with a connection target inserted from the insertion port to a contact position that is in contact with the connection target at a regular mating position.

Since the contact of the front terminal may be provided as the edge portion, the aforementioned rotation operation of the front terminal can be achieved when the edge portion comes into contact with a connection target member.

According to the above aspect of the present invention, the contact of the front terminal and the contact of the rear terminal may be displaced in different directions without being in contact with each other while the contact of the front terminal and the contact of the rear terminal are in contact with a connection target.

Since the contact of the front terminal and the contact of the rear terminal may be displaced in different directions without being in contact with each other while the contact of the front terminal and the contact of the rear terminal are in contact with a connection target, a reliable electric connection can be achieved while preventing the contact portions from being in contact with each other.

Advantageous Effects of Invention

According to the connector of the present invention, the connector terminal can be prevented from being easily bent or buckled when pressed by the connection target. Furthermore, since the front terminal of the connector terminal and the connection target of the rear terminal are not in contact with each other in the mating process in which they are in contact with the connection target, the contacts of the terminals can be in contact with the connection target in a reliable manner. Accordingly, a connector with high connection reliability can be provided.

DESCRIPTION OF EMBODIMENTS

With reference to the drawings, preferred embodiments of the present invention will be described. The following embodiments describe an example of a socket connector 1 that is matingly connected to a plug connector 2 for substrate-to-substrate connection. In the following embodiments, the same reference numbers refer to the same configurations in order to prevent duplicated explanation.

Further, as shown in FIGS. 1 to 4, the longitudinal direction of the connector 1 is referred to as an X direction (right and left direction), a short direction is referred to as a Y direction (front and rear direction), an insertion and withdrawal direction of the plug connector 2 as a "connection target" and the connector 1 is referred to as a Z direction (up and down direction) in the specification, claims, and the drawings. In the up and down direction Z, the direction where the plug connector 2 is located is hereinafter referred to as an "upper side," and the direction where the connector 1 is located is hereinafter referred to as a "lower side". It should be noted that the description of the up and down direction, right and left direction, and front and rear direction does not limit the mounting direction or the usage direction of the connector terminal and the connector of the present invention.

First Embodiment [FIG. 1 to FIG. 10]

Figure 1:
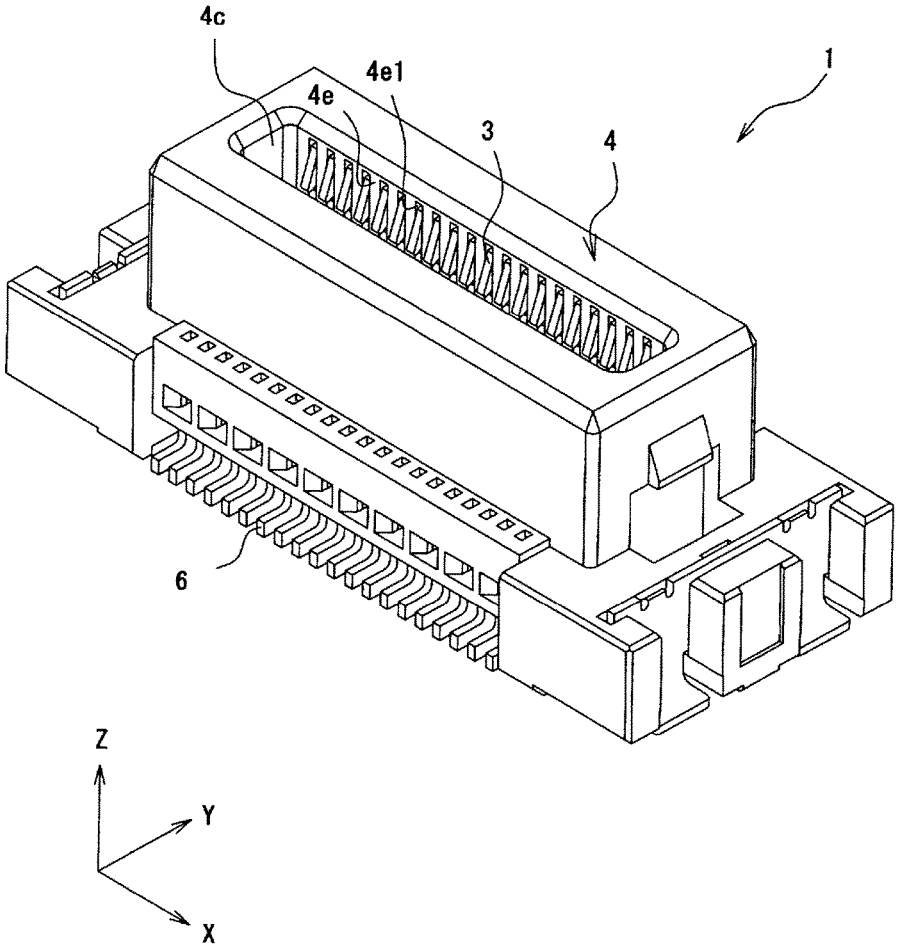
FIG. 1 is a perspective view of a connector according to a first embodiment.
Figure 2:
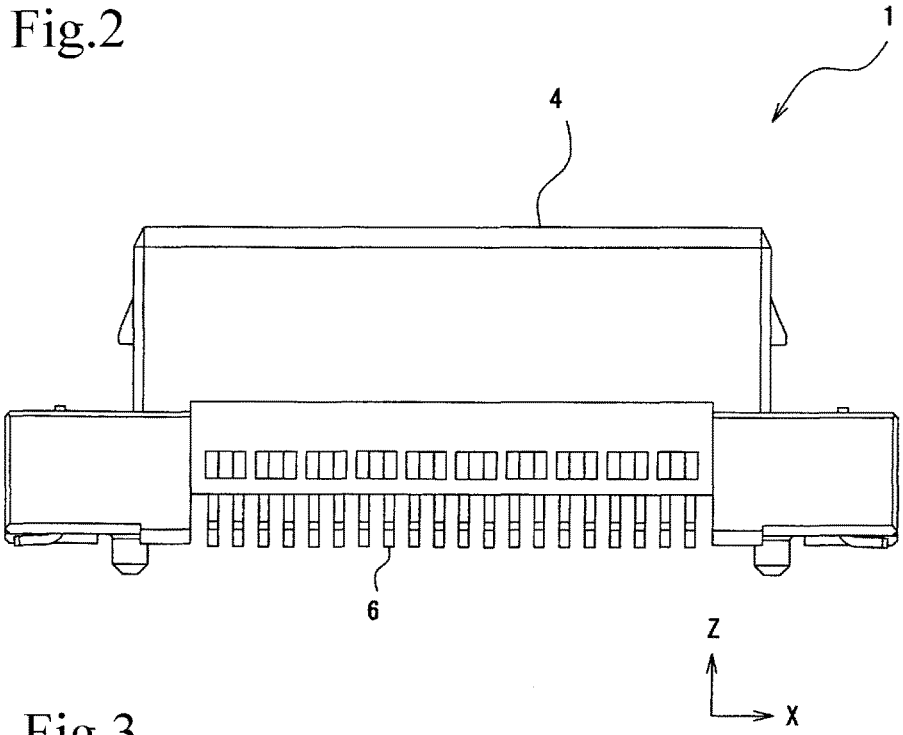
FIG. 2 is a front view of the connector of FIG. 1.
Figure 3:
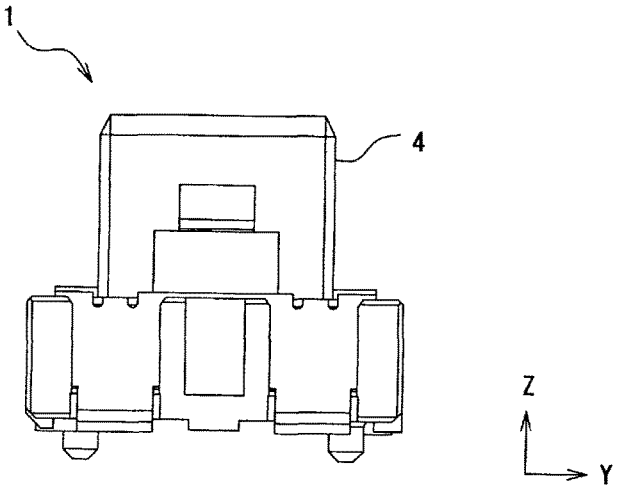
FIG. 3 is a right side view of the connector of FIG. 1.
Figure 4:
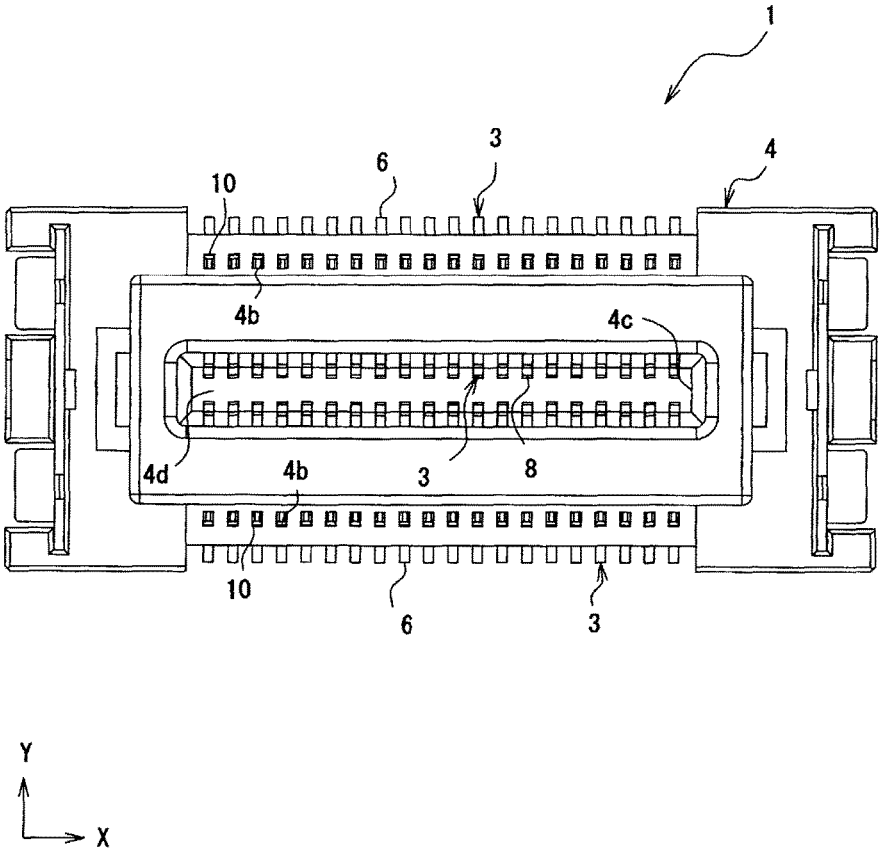
FIG. 4 is a plan view of the connector of FIG. 1.
Figure 5:
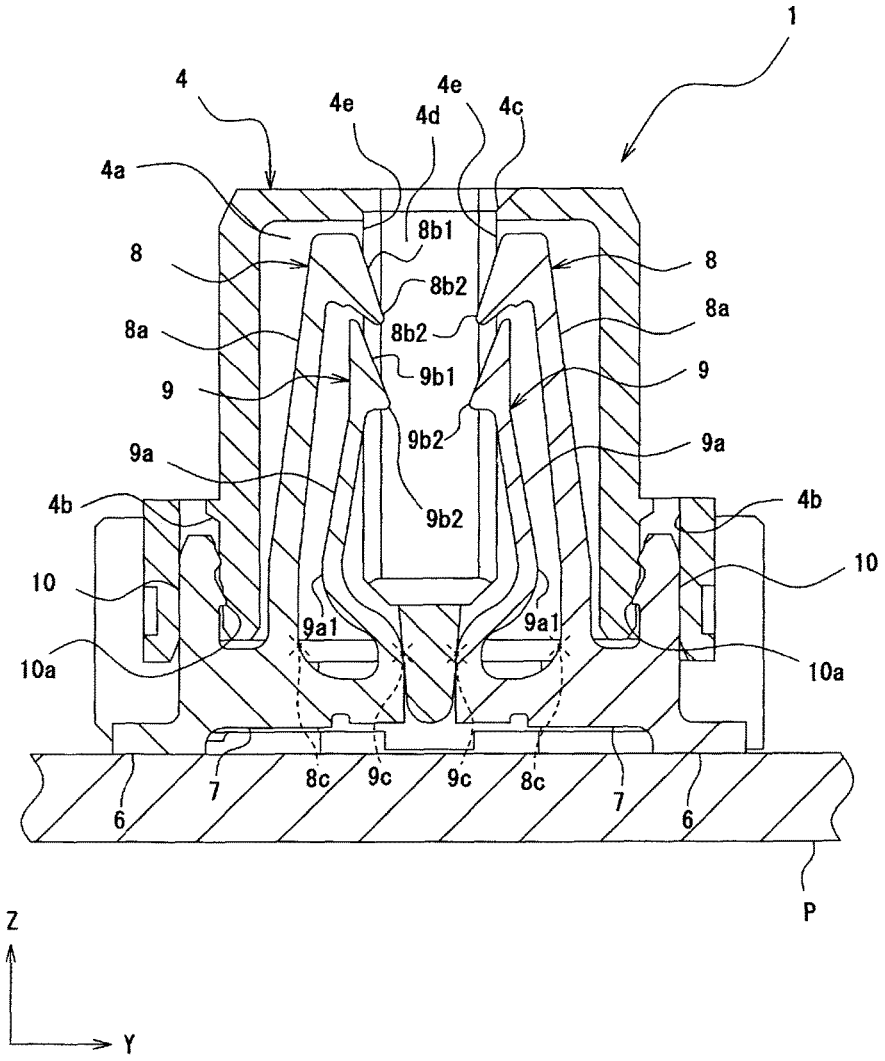
FIG. 5 is a cross sectional view of the connector of FIG. 1.
Figure 6:
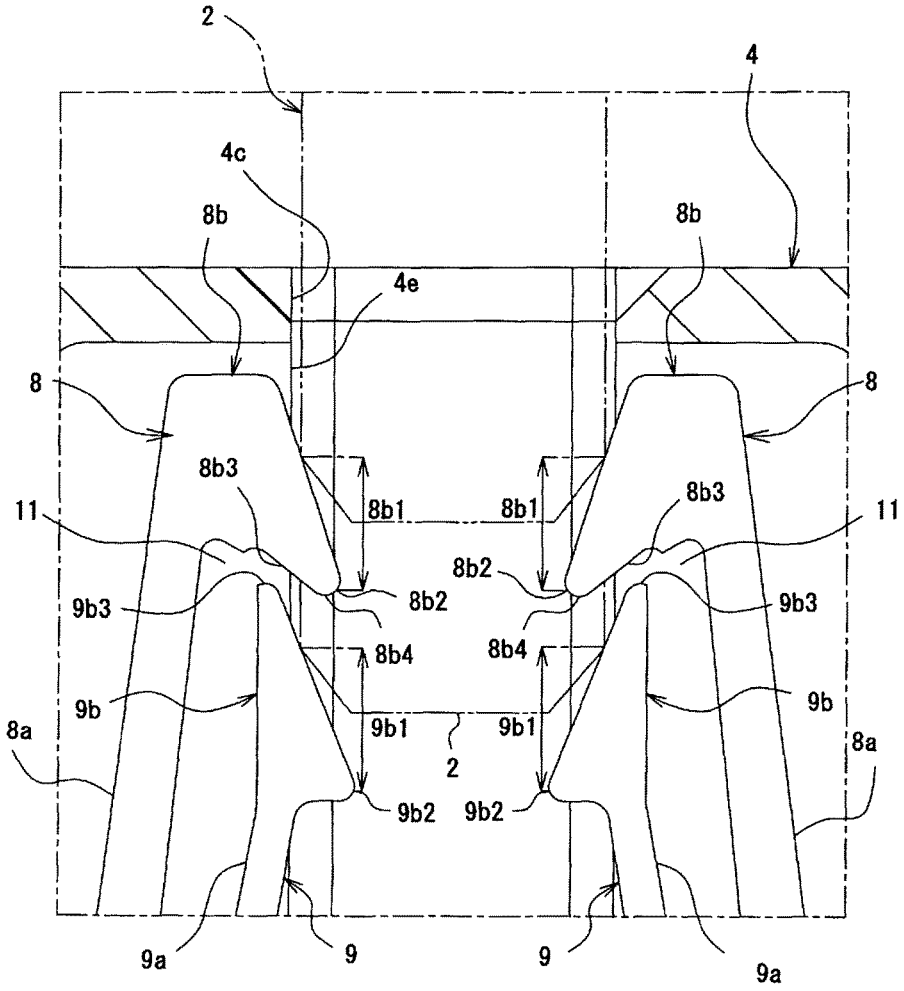
FIG. 6 is a partial enlarged cross sectional view of a contact portion of the connector of FIG. 1.
Figure 9:
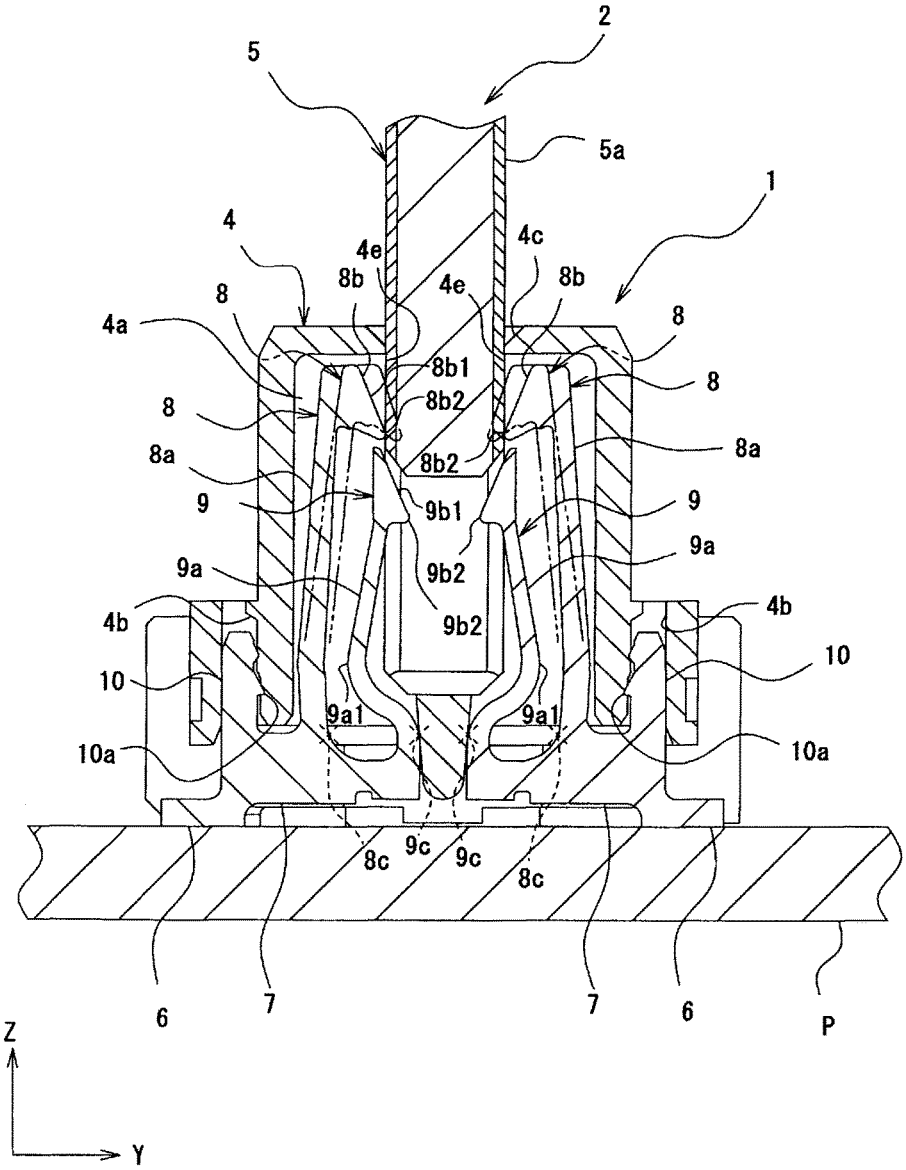
FIG. 9 is an explanatory view which shows that the connector of FIG. 1 mates with a connection target.
Figure 10:
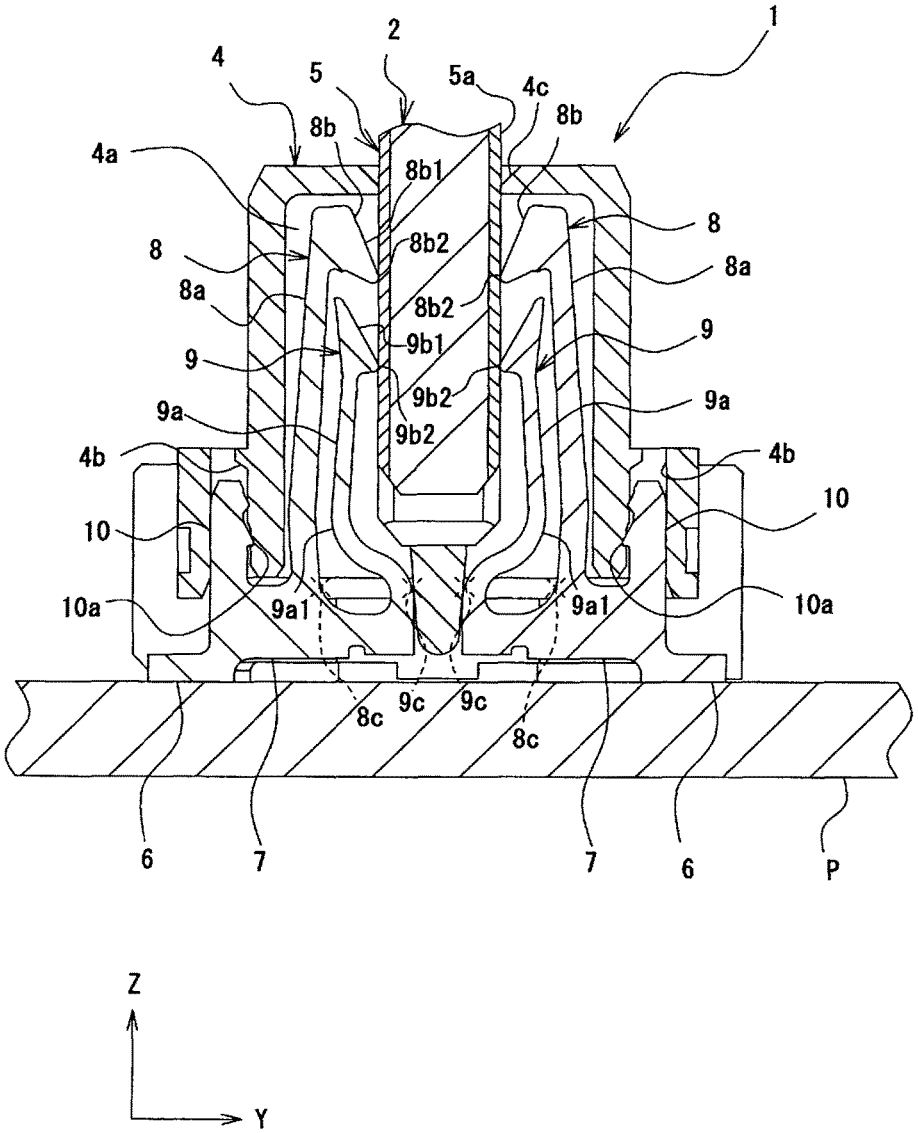
FIG. 10 is an explanatory view which shows that the connector of FIG. 9 further mates with the connection target.

As shown in FIGS. 1 to 4, the connector 1 of the present embodiment includes connector terminals 3 and a housing 4. As shown in FIGS. 5, 9 and 10, the connector 1 is mounted on a substrate P, and the plug connector 2 is mounted on a substrate not shown in the figure. As the connector 1 and the plug connector 2 mate with each other, the substrate P and the substrate on which the plug connector 2 is mounted are electrically connected.

[Housing]

The housing 4 is made of an insulative resin and has a substantially cuboid shape. Further, the housing 4 includes slit-shaped terminal housing grooves 4*a* that house the connector terminals 3, and a fixation hole 4*b* that fixes the connector terminals 3. A plurality of terminal housing grooves 4*a* are arranged side by side in the longitudinal direction X of the connector 1 so that each connector terminal 3 is housed in the corresponding terminal housing groove 4*a*.

Further, the housing 4 has an insertion port 4*c* for the plug connector 2 and a mating chamber 4*d* that communicates with the insertion port 4*c*. The mating chamber 4*d* communicates with the terminal housing grooves 4*a* for the connector terminals 3. The inner wall 4*e* of the mating chamber 4*d* has slits 4*e*1 so that contact portions 8*b*, 9*b* of the connector terminals 3, which will be described later, partially protrude through the slits 4*e*1. Accordingly, the connector terminals 3 are electrically connected to the plug terminal 5 of the plug connector 2 in the mating chamber 4*d*.

[Connector Terminal]

The connector terminal 3 of the present embodiment is a punched terminal formed by press punching a plate-shaped conductive metal. The connector terminals 3, which are housed in the terminal housing grooves 4*a*, are arranged side by side in the longitudinal direction X of the connector 1. As shown in FIGS. 5 to 10, the connector terminal 3 includes a substrate connecting section 6 connected to the substrate, a proximal end 7, a front terminal 8 and a rear terminal 9.

[Substrate Connecting Section]

The substrate connecting section 6 is disposed on an end of the connector terminal 3 so as to be connected to the substrate P. Further, the connector terminal 3 is mounted so that a plate surface is parallel to the short direction Y of the housing 4. The connector terminals 3 are disposed to be opposed to each other with the mating chamber 4*d* of the housing 4 therebetween. The substrate connecting section 6 downwardly protrudes so as to support the housing 4 with a gap between the housing 4 and the substrate P while the fixing piece 10 is fixed to the housing 4.

[Proximal End]

Figure 7:
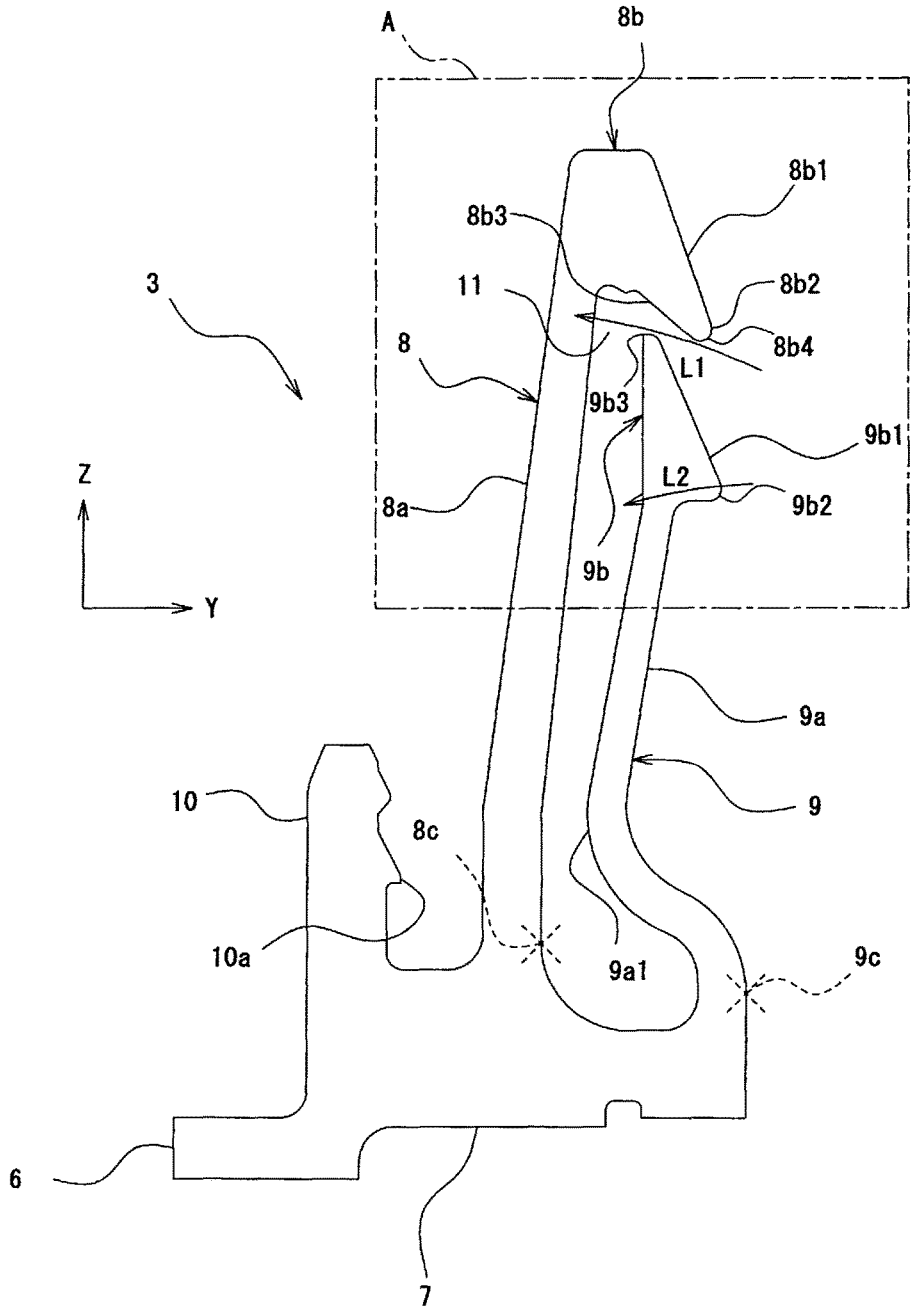
FIG. 7 is a front view of a connector terminal according to the first embodiment.
Figure 8:
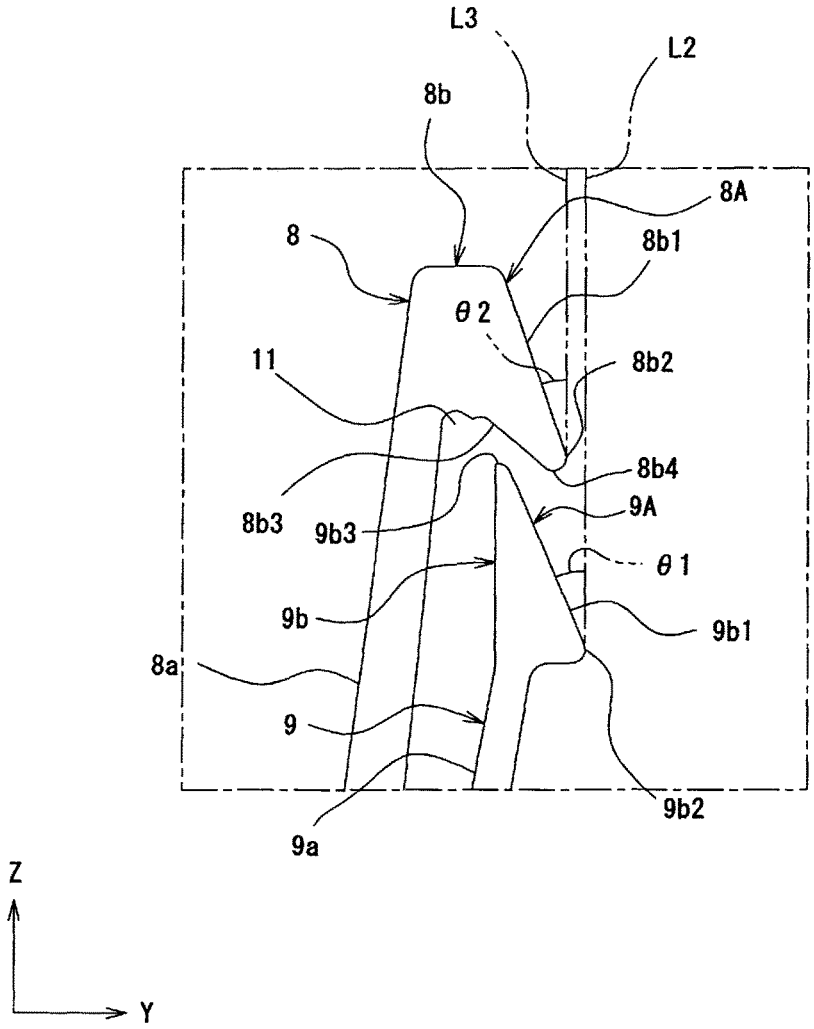
FIG. 8 is a partial enlarged view of an A section of the connector terminal of FIG. 7.

As shown in FIGS. 7 and 8, the proximal end 7 of the connector terminal 3 is disposed adjacent to the substrate connecting section 6. The upper end of the connector terminal 3 is provided with the front terminal 8 which extends upwardly in a cantilever shape. Further, the connector terminal 3 is provided with the rear terminal 9 on the side opposite to the substrate connecting section 6 in the front and rear direction Y. The rear terminal 9 is formed in a cantilever shape which extends upwardly and substantially parallel to the front terminal 8. Further, the fixing piece 10 fixed to the housing 4 is disposed on the proximal end 7 so as to extend upwardly. The fixing piece 10 has an engaging section 10*a* which is fixed to the housing 4 by being press-fitted into the fixation hole 4*b*.

[Front Terminal]

As shown in FIGS. 7 and 8, the front terminal 8 includes an elastic arm 8*a* as an "elastic piece" and a contact portion 8*b* which protrudes into the insertion port 4*c*. The elastic arm 8*a* extends from the proximal end 7 so as to support the contact portion 8*b* in a displaceable manner. The contact portion 8*b* is disposed on the distal end of the elastic arm 8*a*. The contact portion 8*b* includes a contact edge 8A and a rear edge 8*b*3. The contact edge 8A is disposed on one of three sides of the contact portion 8*b* formed in a substantially triangular shape, which is an edge facing the plug connector 2 in a mating position. This edge is inclined to a virtual line L3 which extends in an insertion direction of the plug connector 2 (FIG. 8). Further, the contact edge 8A includes a front contact 8*b*1. The front contact 8*b*1 protrudes from the slit 4*e*1 on the inner wall 4*e* of the housing 4 so as to be in press contact with the plug terminal 5 in the mating chamber 4*d*. The front contact 8*b*1 is disposed on the edge of a portion of the contact edge 8A protruding from the slit 4*e*1. More specifically, the front contact 8*b*1 is a portion of the edge from the contact position that is initially in contact with the plug connector 2 which is inserted into the insertion port 4*c* to the contact position which is in contact with the plug connector 2 in a regular mating position. The front contact 8*b*1 has a function of removing foreign substances attached on a terminal surface 5*a* of a plug terminal 5 during mating of the plug connector 2 and the connector 1. A mating contact 8*b*2 is disposed on a lower end of the front contact 8*b*1. The mating contact 8*b*2 protrudes from the slit 4*e*1 on the inner wall 4*e* of the housing 4 so as to be in contact with the terminal surface 5*a* of the plug terminal 5 which is in the mating chamber 4*d* in a mating state at a regular contact position. The rear edge 8*b*3 is formed to have an acute angle between the rear edge 8*b*3 and the front contact 8*b*1, and a gap 11 between the rear edge 8*b*3 and the elastic arm 8*a*.

[Rear Terminal]

The rear terminal 9 is disposed adjacent to the front terminal 8, and extends upward from the proximal end 7. As shown in FIGS. 7 and 8, the rear terminal 9 includes an elastic arm 9*a* as an "elastic piece" and a contact portion 9*b* which protrudes into the insertion port 4*c*. The elastic arm 9*a* extends from the proximal end 7 so as to support the contact portion 9*b* in a displaceable manner. A connecting portion of the elastic arm 9*a* connected to the proximal end 7 is located inside the mating chamber 4*d* relative to the inner wall 4*e* in the front and rear direction Y. The elastic arm 9*a* has a bent portion 9*a*1 which extends along the mating chamber 4*d* from the connecting portion. Since the contact portion 9*b* has the bent portion 9*a*1, an increased spring length of the elastic arm 9*a* can be achieved in a narrow space of the housing 4 compared with the case where the elastic arm 9*a* straightly extends.

The contact portion 9*b* of the rear terminal 9 is disposed on the distal end of the elastic arm 9*a* on the lower side of the contact portion 8*b* of the front terminal 8. The contact portion 9*b* has a contact edge 9A. The contact edge 9A is disposed on one of three sides of the contact portion 9*b* formed in a substantially triangular shape, which is an edge facing the plug connector 2 in a mating position. This edge is inclined to a virtual line L2 which extends in an insertion direction of the plug connector 2. Further, the contact edge 9A includes a rear contact 9*b*1. The rear contact 9*b*1 protrudes from the slit 4*e*1 on the inner wall 4*e* of the housing 4 so as to be in press contact with the plug terminal 2 in the mating chamber 4*d*. The rear contact 9*b*1 is disposed on the edge of a portion of the contact edge 9A protruding from the slit 4*e*1. More specifically, the rear contact 9*b*1 is a portion of the edge from the contact position that is initially in contact with the plug connector 2 which is inserted into the insertion port 4*c* to the contact position which is in contact with the plug connector 2 in a regular mating position. The rear contact 9*b*1 is in press contact with the terminal surface 2*a* of the plug terminal 5 in the mating chamber 4*d*. A mating contact 9*b*2 is disposed on a lower end of the rear contact 9*b*1 so as to be in contact with the plug terminal 5. The mating contact 9*b*2 protrudes from the slit 4*e*1 on the inner wall 4*e* of the housing 4 so as to be in contact with the terminal surface 5*a* of the plug terminal 5 in the mating chamber 4*d* at a regular contact position.

Further, a distal end 9*b*3 of the contact portion 9*b* is formed in a chevron shape protruding upward. A height position of the distal end 9*b*3 is provided higher than the lower end of the contact portion 8*b* of the front terminal 8 so that the distal end 9*b*3 is housed in the gap 11. With this configuration, the position of the distal end 9*b*3 is limited in the gap 11. Accordingly, the distal end 9*b*3 of the rear terminal 9 does not protrude from the terminal housing groove 4*a* into the mating chamber 4*d* of the housing 4, thereby preventing the distal end 9*b*3 of the rear terminal 9 from being bent or buckled toward inside of the mating chamber 4*d* by the plug connector 2 abutting during mating. Further, since the distal end 9*b*3 of the contact portion 9*b* is housed in the gap 11, an increased spring length of the elastic arm 9*a* can be achieved in a narrow space of the housing 4.

When the connector terminal 3 is subject to an external force during mounting on the housing 4, the elastic arm 9*a* of the rear terminal 9 may be bent from a continuous portion to the proximal end 7 toward the mating chamber 4*d*. However, according to the connector terminal 3 of the present embodiment, even if such a failure occurs, the distal end 9*b*3 of the contact portion 9*b* of the rear terminal 9 comes into contact with the contact portion 8*b* of the front terminal 8. Accordingly, occurrence of a failure of protruding of the contact portion 9*b* into the mating chamber 4*d* can be prevented. This can prevent mating failure due to buckling or bending of the rear terminal 9 into the mating chamber 4*d* caused by the plug connector 2 abutting the distal end 9*b*3 of the contact portion 9*b* of the rear terminal 9 during mating. Further, if the rear terminal 9 comes into contact with the plug connector 2 and is displaced, there may be a case where a failure may occur in which the rear terminal 9 comes into contact with the front terminal 8. However, it is possible to avoid a large problem due to buckling or bending of the rear terminal 9 into the mating chamber 4*d* caused by the plug connector 2 abutting the distal end 9*b*3 of the rear terminal 9 which protrudes into the mating chamber 4*d* during mating. Accordingly, contact by the contact portion 9*b* of the rear terminal 9 can be ensured.

The contact pressure of the rear terminal 9 is set higher than the contact pressure of the front terminal 8. This relation of the contact pressure can be achieved, for example, by narrowing the interval between the mating contacts 9*b*2, 9*b*2 of the rear terminals 9, 9 of the connector terminals 5, 5 which are opposed in the housing 4 with the mating chamber 4*d* interposed therebetween compared with the interval between the mating contacts 8*b*2, 8*b*2 of the front terminals 8, 8. Further, with this configuration, the rear terminals 9 can be disposed closer to the plug connector 2 in a mating state than the front terminals 8 is. Accordingly, the contact edges 9A or the mating contacts 9*b*2 of the rear terminals 9 which are disposed in the mating chamber 4*d* at deeper positions in the insertion direction of the plug connector 2 can be reliably brought into contact with the plug connector 2. Further, the spring constant of the rear terminal 9 is also set higher than the spring constant of the front terminal 8. Accordingly, the rear terminal 9 is ensured to be in contact of with the plug connector 2, thereby further improving connection reliability of the rear terminal 9.

[Foreign Substance Removing Function of Front Terminal]

As the plug connector 2 mates with the connector 1, the plug terminal 5 and the connector terminal 3 are electrically connected. However, there may be a case where a foreign substance such as substrate residue or dust is attached on the terminal surface 5*a* of the plug terminal 5. In this case, when the rear contact 9*b*1 comes into contact with the terminal surface 5*a* of the plug terminal 5, a foreign substance is caught between the rear contact 9*b*1 and the terminal surface 5*a* of the plug terminal 5, leading to unstable electric connection between the rear contact 9*b*1 and the plug terminal 5.

On the other hand, according to the connector 1 of the present embodiment, the front contact 8*b*1 of the front terminal 8 is disposed on the upper side of the rear contact 9*b*1 as shown in FIGS. 5 to 10. With this configuration, when the plug connector 2 is inserted into the connector 1, a foreign substance attached on the terminal surface 5*a* of the plug terminal 5 can be wiped off by the front contact 8*b*1 by allowing the front contact 8*b*1 and the rear contact 9*b*1 to be sequentially sliding contact with the terminal surface 5*a* of the plug terminal 5. After that, the rear contact 9*b*1 comes into contact with the wiped portion to achieve stable electric connection between the rear contact 9*b*1 and the plug terminal 5 without a foreign substance caught between the rear contact 9*b*1 and the plug terminal 5.

[Contact Prevention Structure of Rear Terminal and Front Terminal]

In this embodiment, the front contact 8*b*1 of the front terminal 8 in a non-mating state is disposed at a position closer to the plug terminal 5 in a mating position than a displacement fulcrum 8*c* of the elastic arm 8*a* is in the front and rear direction Y. Accordingly, the elastic arm 8*a* is formed to be inclined from the connecting portion connected to the proximal end 7 to the distal end in a mating direction with the plug terminal 5. Further, when the plug terminal 5 is in press contact with the front contact 8*b*1 of the front terminal 8 during mating of the plug connector 2 and the connector 1, the elastic arm 8*a* is rotated in an upright direction (indicated by the arrow L1 in FIG. 7) about the displacement fulcrum 8*c* which is located at the root of the elastic arm 8*a*. In so doing, since the distance between the front contact 8*b*1 and the displacement fulcrum 8*c* remains the same, the front contact 8b1 is displaced separating from the plug terminal 5 while moving in an arc to the obliquely upper side in a direction away from the displacement fulcrum 8c. Further, since the entire length of the front contact 8b1 is located at a position closer to the plug terminal 5 in a mating position than the displacement fulcrum 8c is, the contact portion 8b of the front terminal 8 can be rotated in the above direction so as to ensure it moves away from the rear terminal 9.

On the other hand, a displacement fulcrum 9c located at the root of the elastic arm 9a of the rear terminal 9 in a non-mating state is disposed at a position closer to the plug terminal 5 in a mating position than the rear contact 9b1 is in the front and rear direction Y. Accordingly, a straight line connecting the displacement fulcrum 9c and the rear contact 9b1 (which is not shown in the figure) is inclined toward the front terminal 8 in a direction indicated by the arrow L2 (FIG. 8). In this case, when the plug terminal 5 is in press contact with the rear contact 9b1 of the rear terminal 9, the contact portion 9b is displaced to the obliquely lower side in contrast to the contact portion 8b of the front terminal 8.

Since the contact portion 8b of the front terminal 8 is displaced to the obliquely upper side and the contact portion 9b of the rear terminal 9 is displaced to the obliquely lower side, the distal end 9b3 of the contact portion 9b of the rear terminal 9 can be escaped from the gap 11 of the front terminal 8 without touching the front terminal 8. Then, the contact portion 8b of the front terminal 8 and the contact portion 9b of the rear terminal 9 are connected to the plug terminal 5 in a state of being displaced away from each other.

Further, in the present embodiment, the insertion direction of the plug connector 2 is the down direction of the connector 1. When the plug connector 2 is inserted, the contact portion 9b of the rear terminal 9 is displaced to the obliquely lower side. That is, when an operator inserts the plug connector 2 into the connector 1, he/she applies a pressing force in the down direction of the up and down direction Z to insert the plug connector 2 into the connector 1. Here, the rear terminal 9 does not resist the pressing force from the plug connector 2 and is displaced downward in the insertion direction of the plug connector 2. As a result, the operator can smoothly perform a mating operation with reduced resistance applied in insertion of the plug connector 2 into the connector 1.

According to the connector 1 of the present embodiment, even if the rear terminal 9 is pressed and displaced by the plug connector 2, the rear terminal 9 can be prevented from being easily in contact with the elastic arm 8a of the front terminal 8. Therefore, the connector terminal 3 can be prevented from being easily bent or buckled when pressed by the plug connector 2. In addition to that, since the contact pressure of the rear terminal 9 can be easily maintained, the connector 1 with high connection reliability can be provided.

Figure 11:
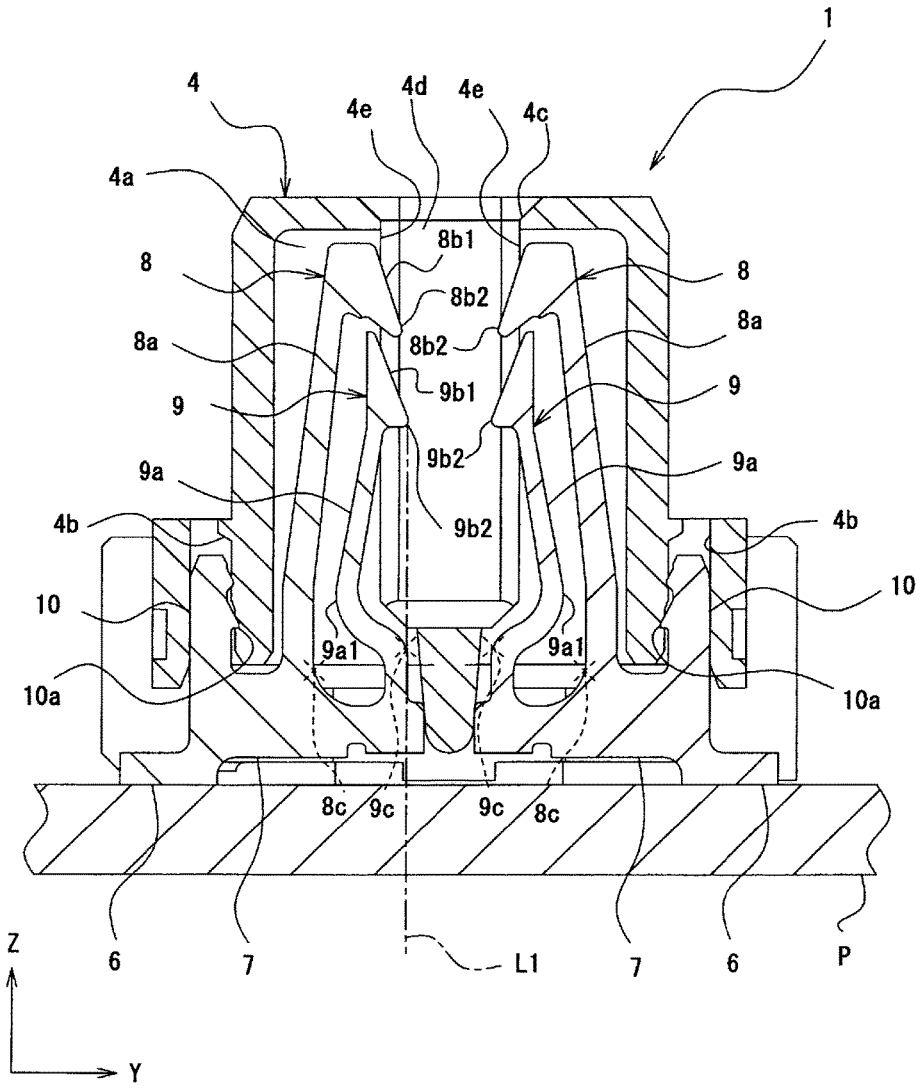
FIG. 11 is a cross sectional view of the connector according to a second embodiment.

Second Embodiment [FIG. 11]

In the first embodiment, an example has been described in which the displacement fulcrum 9c of the elastic arm 9a of the rear terminal 9 is located closer to the plug connector 2 in the mating position than the rear contact 9b1 of the contact portion 9b which is in press contact with the plug connector 2 is. On the other hand, as shown in FIG. 11, the displacement fulcrum 9c of the elastic arm 9a of the rear terminal 9 may be disposed at the same position as the rear contact 9b1 in the contact direction of the plug connector 2 (on the contact line L1). In this case, the contact portion 9b of the rear terminal 9 is slightly displaced toward the front terminal 8 in the front and rear direction Y, and then the contact portion 9b of the rear terminal 9 is displaced to the obliquely lower side. Accordingly, in this case as well, the contact portion 9b of the rear terminal 9 can be displaced in the direction away from the contact portion 8b of the front terminal 8. Further, specifically in this case, the displacement fulcrum 9c of the elastic arm 9a of the rear terminal 9 may be disposed at the same position as the mating contact 9b2 in the contact direction of the plug connector 2. With this configuration, the substantially entire portion of the contact portion 9b can be rotated in an arc toward the obliquely lower side. Accordingly, the substantially entire portion of the contact portion 9b can be displaced toward the obliquely lower side, which is a direction away from the contact portion 8b of the front terminal 8.

Figure 12:
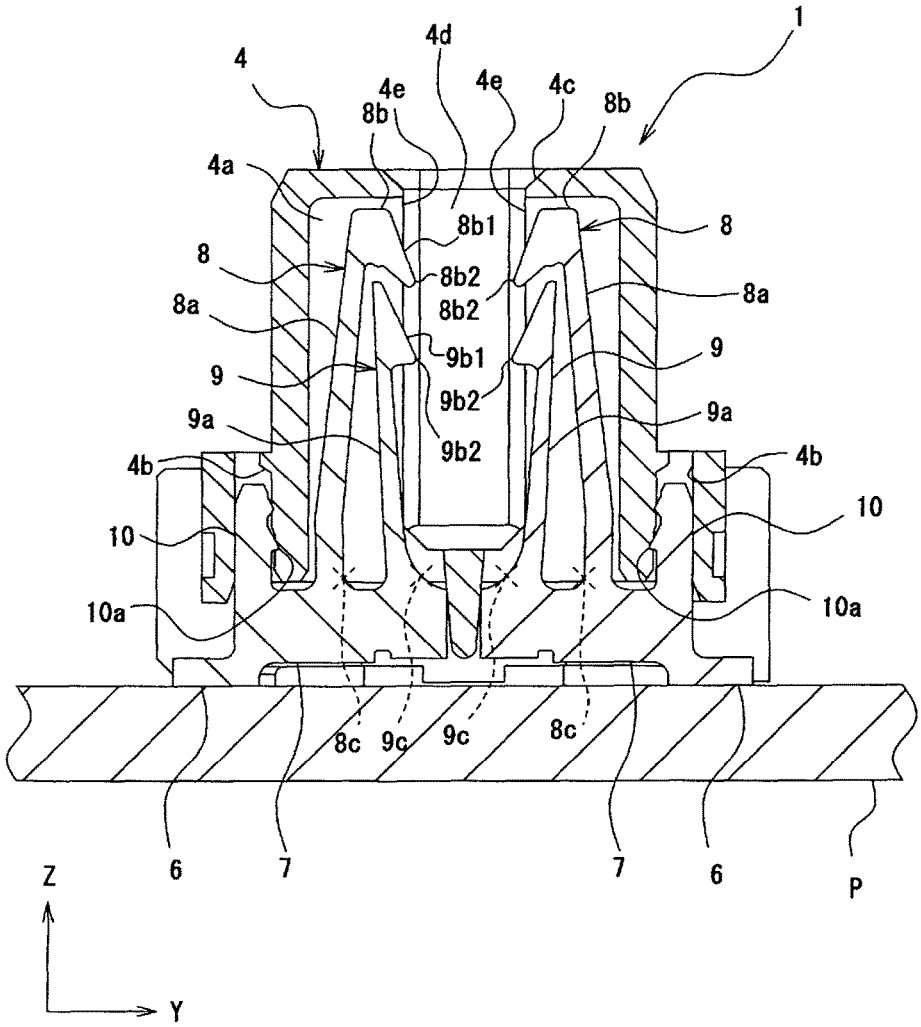
FIG. 12 is a cross sectional view of the connector according to a third embodiment.

Third Embodiment [FIG. 12]

In the above embodiments, an example has been described in which the elastic arm 9a of the rear terminal 9 includes the bent portion 9a1. On the other hand, the elastic arm 9a of the rear terminal 9 may not necessarily include the bent portion 9a1 and may be formed in a substantially straight shape. In this case, although a spring length of the elastic arm 9a is decreased compared with that having the bent portion 9a1, the material cost for the connector terminal 3 can be reduced since it does not have a long spring length.

Figure 13A:
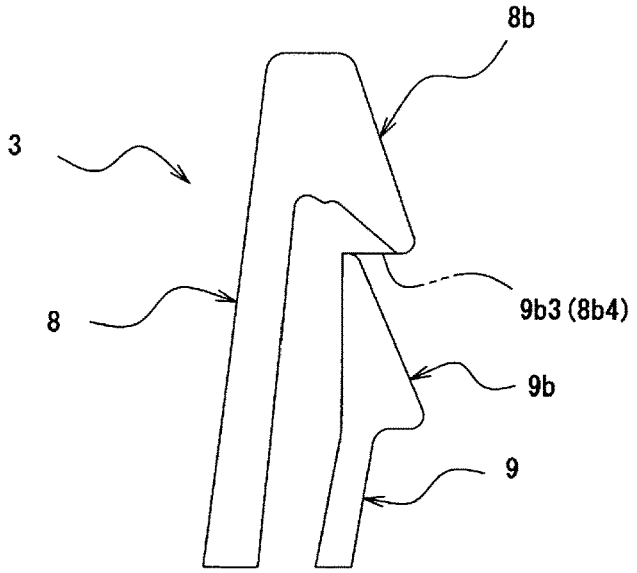
FIG. 13 is a partial enlarged view of the connector terminal of a modification example corresponding to FIG. 8, in which Sub-figure (*a*) shows a case where a lower end of the contact portion of the front terminal and a distal end of the contact portion of the rear terminal have the same height position, and Sub-figure (*b*) shows a case where the lower end of the contact portion of the front terminal is disposed on the upper side of the distal end of the rear terminal.
Figure 13B:
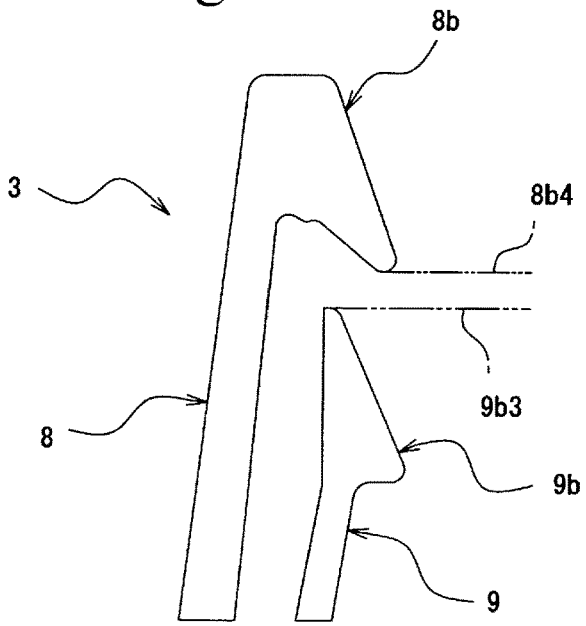

Modification Example [FIG. 13]

In the above embodiments, an example has been described in which the gap 11 is provided between the rear edge 8b3 and the elastic arm 8a of the front terminal 8, and the height position of the distal end 9b3 of the contact portion 9b of the rear terminal 9 is provided higher than the lower end of the contact portion 8b of the front terminal 8 so that the distal end 9b3 of the contact portion 9b of the rear terminal 9 is housed in the gap 11. However, as shown in sub-figure (*a*) of FIG. 13, the lower end 8b4 of the contact portion 8b of the front terminal 8 and the distal end 9b3 of the contact portion 9b of the rear terminal 9 may be at the same height position. In this case, the front terminal 8 is disposed to cover the upper side of the distal end 9b3 of the contact portion 9b of the rear terminal 9 so as to prevent the plug connector 2 from abutting the distal end 9b3 of the contact portion 9b of the rear terminal 9. In addition, compared with the case where the distal end 9b3 of the contact portion 9b of the rear terminal 9 is housed in the gap 11 as described above, the contact portion 9b of the rear terminal 9 and the contact portion 8b of the front terminal 8 are separated from each other so as not to easily come into contact with each other.

Further, as shown in sub-figure (*b*) of FIG. 13, the distal end 9b3 of the contact portion 9b of the rear terminal 9 may be provided lower than the lower 8b4 end of the contact portion 8b of the front terminal 8. In this case, the contact portion 8b of the front terminal 8 and the contact portion 9b of the rear terminal 9 are disposed at positions separated from each other so as not to easily come into contact with each other.

Moreover, an angle θ1 of the rear contact 9b1 of the rear terminal 9 to the virtual line L2 which is along the insertion direction of the plug connector 2 can be set smaller than an angle θ2 of the front contact 8b1 of the front terminal 8 to the virtual line L3 (FIG. 8). With this configuration, an insertion force in insertion of the plug connector 2 can be reduced while increasing the contact pressure of the rear terminal 9 so as to achieve a reliable contact force, thereby improving an operation efficiency during mating.

In the above embodiments, an example has been described in which the distal end 9*b*3 does not come into contact with the front terminal 8 and protrude into the mating chamber 4*d* even if the rear terminal 9 deforms due to manufacturing reasons. On the other hand, if there is no need of accommodating such a problem, the front terminal 8 may be provided so as to be in contact with the rear terminal 9 (as an example, see sub-figure (*b*) of FIG. 13).

REFERENCE SIGNS LIST

1 connector (first embodiment)
2 plug connector
2*a* terminal surface
3 connector terminal
4 housing
4*a* terminal housing groove
4*b* fixation hole
4*c* insertion port
4*d* mating chamber
4*e* inner wall
4*e*1 slit
5 plug terminal
5*a* terminal surface
6 substrate connecting section
7 proximal end
8 front terminal
8A contact edge
8*a* elastic arm
8*b* contact portion
8*b*1 front contact
8*b*2 mating contact
8*b*3 rear edge
8*b*4 lower end
8*c* displacement fulcrum
9 rear terminal
9A contact edge
9*a* elastic arm
9*a*1 bent portion
9*b* contact portion
9*b*1 rear contact
9*b*2 mating contact
9*b*3 distal end
9*c* displacement fulcrum
10 fixing piece
10*a* engaging section
11 gap
X longitudinal direction, width direction
Y short direction, front and rear direction
Z insertion and withdrawal direction, up and down direction
P substrate
L1 contact line
L2 virtual line
L3 virtual line

The invention claimed is:

1. A electric connector comprising:

a housing and a connector terminal, the connector terminal including:

a front terminal including a contact portion that comes into contact with a connection target inserted from an insertion port of the housing and an elastic piece that supports the contact portion in a displaceable manner; and a rear terminal including a contact portion that comes into contact with the connection target subsequent to the contact portion of the front terminal and an elastic piece that supports the contact portion of the rear terminal in a displaceable manner; and a proximal end supporting and directly connected to both the front terminal and the rear terminal, the proximal end being fixed to the housing, wherein the connector terminal is a plate-shaped punched terminal formed by a plate-shaped conductive metal, wherein the elastic piece of the front terminal and the elastic piece of the rear terminal extends directly from an edge portion of the proximal end, wherein the rear terminal includes a contact that is disposed on the contact portion and comes into contact with the connection target inserted from the insertion port, and the elastic piece has a displacement fulcrum which is located at a position closer to the connection target inserted in the housing than to the contact is, and wherein the contact of the rear terminal is a portion of an edge of the plate-shaped conductive metal from a contact position that is initially in contact with the connection target inserted from the insertion port to a contact position that is in contact with the connection target at a regular mating position.

2. The electric connector according to claim 1, wherein the front terminal includes a contact that comes into contact with the connection target inserted from the insertion port, and the contact is located at a position closer to the connection target inserted in the housing than the displacement fulcrum of the elastic piece of the front terminal is.

3. The electric connector according to claim 1, wherein the front terminal includes a gap between the contact portion and the elastic piece so as to house an end of the contact portion of the rear terminal which faces the insertion port.

4. The electric connector according to claim 2, wherein the contact of the front terminal is a portion of an edge from a contact position that is initially in contact with the connection target inserted from the insertion port to a contact position that is in contact with the connection target at a regular mating position.

5. The electric connector according to claim 2, wherein the contact of the front terminal and the contact of the rear terminal are displaced in different directions without being in contact with each other while the contact of the front terminal and the contact of the rear terminal are in contact with the connection target.

6. The electric connector according to claim 1, wherein the proximal end is provided between the front terminal and the rear terminal.

* * * * *